United States Patent [19]

Chase

[11] 4,062,264

[45] * Dec. 13, 1977

[54] POLYPHONIC MUSICAL INSTRUMENT SIMULATOR

[76] Inventor: Willis E. Chase, P.O. Box 4042, Lancaster, Calif. 93534

[ * ] Notice: The portion of the term of this patent subsequent to Dec. 24, 1991, has been disclaimed.

[21] Appl. No.: 547,873

[22] Filed: Feb. 7, 1975

[51] Int. Cl.[2] ..... G10H 1/02

[52] U.S. Cl. ..... 84/1.24; 84/1.11; 84/1.19; 84/1.26

[58] Field of Search ..... 84/1.01, 1.11, 1.12, 84/1.13, 1.19, 1.24, 1.26

[56] References Cited

U.S. PATENT DOCUMENTS

| | | | |
|---|---|---|---|
| 3,063,324 | 11/1962 | Campbell | 84/1.19 |
| 3,091,148 | 5/1963 | Munch, Jr. | 84/1.19 |
| 3,161,713 | 12/1974 | Martinez | 84/1.19 |
| 3,205,294 | 9/1965 | Maynard | 84/1.11 |
| 3,255,296 | 6/1966 | Peterson | 84/1.19 |
| 3,321,567 | 5/1967 | Munch et al. | 84/1.19 |
| 3,398,378 | 8/1968 | Olson | 84/1.19 |
| 3,544,694 | 12/1970 | Freeman | 84/1.11 |
| 3,555,167 | 1/1971 | Padalino | 84/1.19 |
| 3,855,893 | 12/1974 | Chase | 84/1.24 |

*Primary Examiner*—Robert K. Schaefer
*Assistant Examiner*—Vit W. Miska

[57] ABSTRACT

An electronic musical instrument having a plurality of frequency sources driving a plurality of waveshape controlling circuits rendered operative by a plurality of keyswitches comprising a keyboard to produce polyphonically, organ voices, piano and harpsichord voices, accordian voices, and other voices characterized by changing harmonic structure as the key is held down.

13 Claims, 12 Drawing Figures

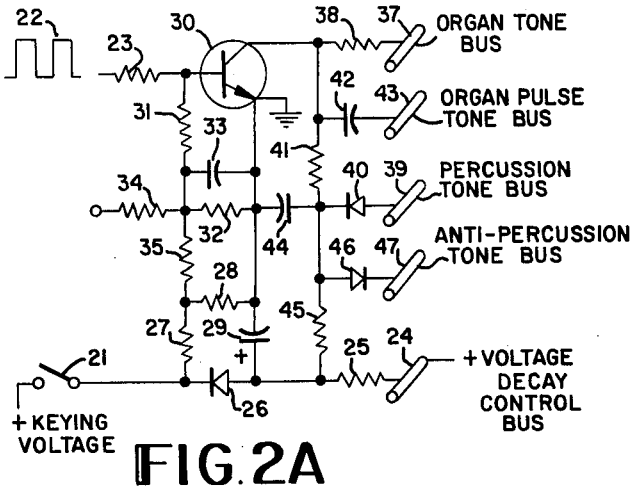
FIG. 2A
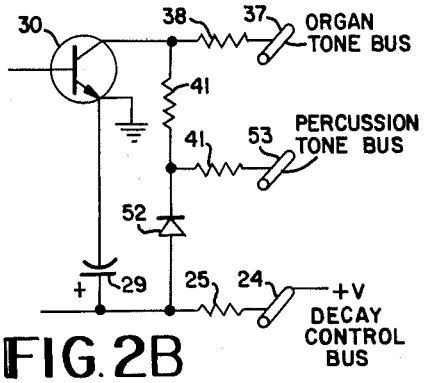
FIG. 2B
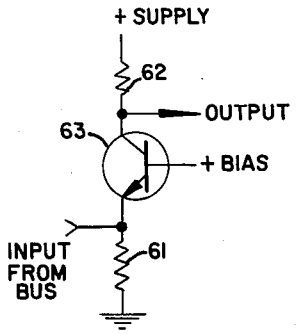
FIG. 3
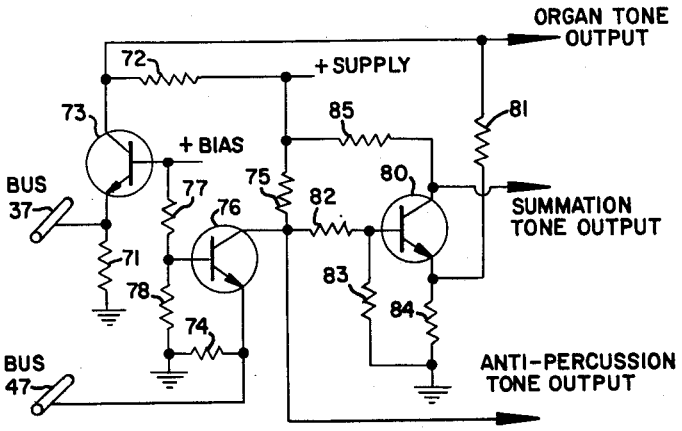
FIG. 4
FIG. 5A
FIG. 5B
FIG. 5C
FIG. 5D
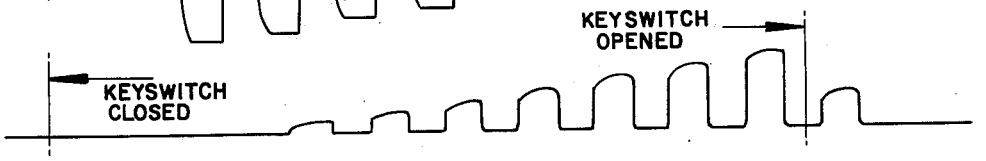
FIG. 5E
FIG. 5F
FIG. 5G

POLYPHONIC MUSICAL INSTRUMENT SIMULATOR

DESCRIPTION OF THE PRIOR ART

Electronic organs have provided organ tone and percussion tone from the same instrument in the past. They have, however, used separate circuitry to produce organ tone and to produce percussed tone.

This increased the complexity, and therefore, the cost of the instrument.

Electronic musical instruments have been made in the past having circuitry that caused the harmonic structure of the tone to vary as the key was held. This, however, was separate from the circuitry porducing organ tone and from the circuitry producing percussion tone. This, if included in the instrument, further increased the complexity and cost.

Means are herein defined where organ tone generation and percussion tone generation and/or accordian tone generation are achieved in a single circuit. This results in a musical instrument of less complexity and lower cost as compared with an instrument of prior art and equivalent specification. In addition, ways are herein described where tones whose harmonic structure changes as a function of the time the key is held down are made available from these means at small additional cost.

SUMMARY OF THE INVENTION

There is provided by the present invention a novel and improved electronic musical instrument employing a plurality of independent waveshape controlling circuits, each one of which is brought into action by one of a plurality of keys making up a keyboard, and whose outputs are combined into preamplifiers such that one or more organ tone waveshapes are available, a percussion tone (e.g. piano) is available, an anti-percussion tone (e.g. accordian) is available, and tones whose harmonic structure change slowly as the key is held as a function of time from the actuation of said key are available.

Therefore the present invention, as compared with prior art, economizes on, or conserves the number of circuit components necessary to fully implement an electronic musical instrument having the resources of organ, piano, accordian, and synthesizer type sounds while not being limited to these specific sounds while providing these resources polyphonically because of having an independent waveshape controlling circuit of the present invention per key.

It is therefore an object of the invention to provide an electronic musical instrument whose individual notes are derived from waveshape controlling circuits, the outputs of which are collected into preamplifiers to provide notes that are percussed, that are steady, that are anti-percussed, and that have changing harmonic structure.

Another object of the invention is to provide a novel and improved electronic musical instrument whose individual waveshape controlling circuits are selectively keyed into operation by selected keyswitches providing control for a plurality of different outputs of dissimilar keying envelope.

Still another object of the invention is to combine these different outputs of dissimilar keying envelope in the preamplifiers in such a way that further waveshapes are made available whose harmonic structure changes as a function of time from when the key is first depressed, and while the key is held down.

Yet another object of the invention is to provide a novel and improved electronic musical instrument having a plurality of frequency sources for establishing the pitch of the several waveshape controlling circuits.

And still another object of the invention is to obtain organ, piano, harpsichord, accordian, and synthesizer like effects polyphonically in an electronic musical instrument by economy of means.

BRIEF DESCRIPTION OF THE DRAWINGS

The features of the present invention which are believed to be novel are set forth with particularity in the appended claims. The present invention, both as to its organization and manner or operation, together with further objects and advantages thereof, may best be understood by reference to the following description, taken in connection with the accompanying drawings in which:

FIGS. 2A and 2B are schematics of a representative waveshape controlling circuit, and one of the possible variations on this circuit;

FIG. 3 is representative of a preamplifier that may be used in conjunction with the waveshape controlling circuit;

FIG. 4 is representative of two preamplifiers that may be used in conjunction with the waveshape controlling circuit connected to a representative preamplifier that performs summation of the outputs of the first two preamplifiers; and FIGS. 5A–5G depict waveforms illustrative of signals present at input and output of the applicant's waveshape controlling circuit including those present at the output of the summation preamplifiers.

DESCRIPTION OF THE PREFERRED EMBODIMENT

Figure 1:
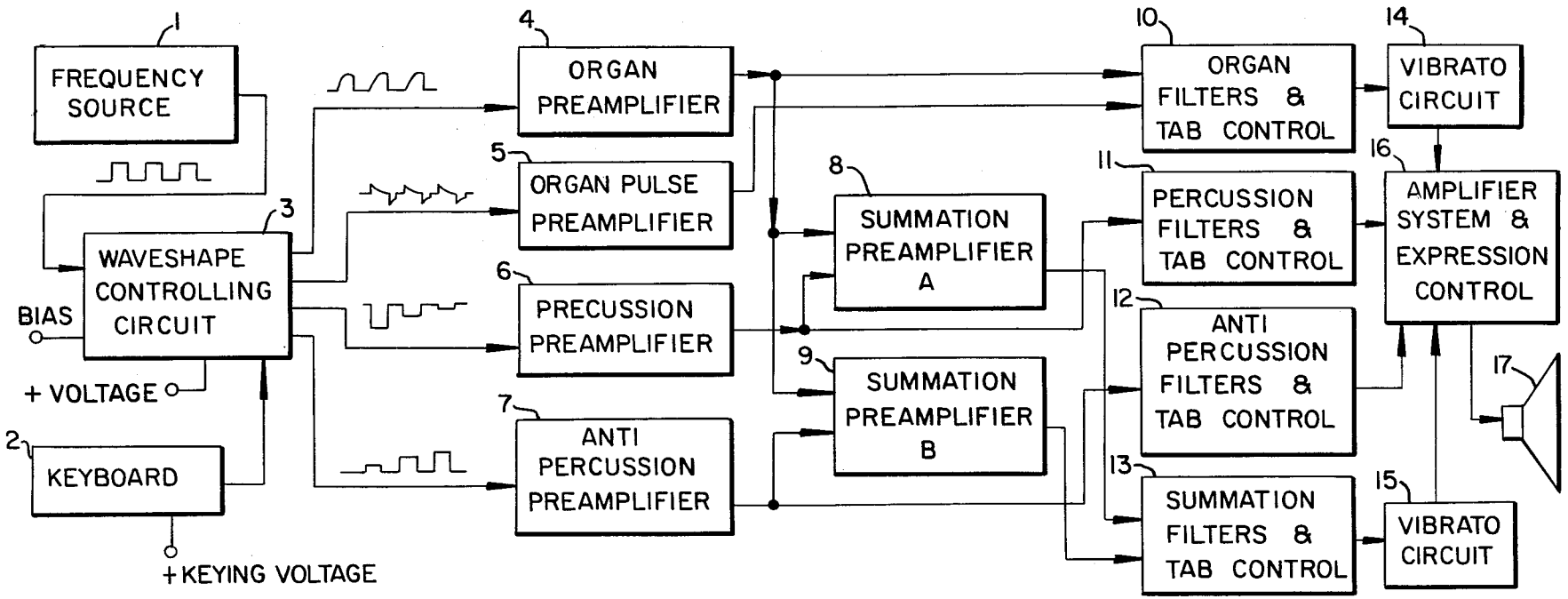
FIG. 1 is a block diagram of an electronic musical instrument of the keyboard type incorporating the applicant's waveshape controlling circuit.

There is shown in FIG. 1 a block diagram illustrating the arrangement of the major subsystems comprising an exemplary embodiment of the invention. Frequency source 1 supplies rectangular waves continuously at a given rate, each of which corresponds to a semitone of the musical scale. This frequency source may be of master oscillator and divider construction. Its primary function is to establish the frequencies and the invention is not limited as to the type of frequency source used.

Keyboard 2, operated by the performer, comprises keys which operate keyswitches which in turn selectively apply voltage to the waveshape controlling circuits 3, there being one waveshape controlling circuit in the illustrated embodiment for each key and a corresponding semitone available to the waveshape controlling circuit from the frequency source.

When a given key of keyboard 2 is operated, its keyswitch causes its selected waveshape controlling circuit 3 to begin operation and to cause the waveshape available to it from frequency source 1, whose frequency corresponds to the key operated, to be controlled in amplitude and modified in harmonic content as a function of time as the key is held in operation.

Waveshape controlling circuit 3, when operated by keyboard 2 has, in the illustrated embodiment, four outputs which are collected in four different preamplifiers. Each preamplifier collects the outputs of several waveshape controlling circuits to achieve economy of means. Organ preamplifier 4 collects the output having a steady amplitude and harmonic structure as the key is held. Organ pulse preamplifier 5 collects the output having a steady amplitude while the key is held but whose harmonic structure differs from that collected in organ preamplifier 4. Percussion preamplifier 6 collects the output having an initial high amplitude which decreases to a low, or no amplitude as the key is held. Anti-percussion preamplifier 7 collects the output having an initial no, or low amplitude which increases to a high amplitude as the key is held. This output is designated "anti-percussion" because it is opposite from "percussion" in the way that its amplitude changes as the key is held. The harmonic structure of the percussion, and the anti-percussion outputs can be made to change as the amplitude of their output changes.

Output from organ preamplifier 4 and output from percussion preamplifier 6 is added together in phase opposition in the illustrated embodiment in summation preamplifier A 8 for the purpose of producing an output waveshape which is initially weak in fundamental but rich in harmonics when the key is first operated, which then gradually changes to one strong in fundamental and weaker in harmonics as the key is held.

Output from organ preamplifier 4 and output from anti-percussion preamplifier 7 is added together in phase opposition in the illustrated embodiment in summation preamplifier B 9 for the purpose of producing an output waveshape which is initially strong in fundamental and weak in harmonics, which then gradually changes to one weak in fundamental but rich in harmonics as the key is held.

It may be easily seen by one skilled in the art where many more useful combinations may be produced by summation of the outputs of the waveshape controlling circuit 3 in either phase aiding or phase opposition configuration and especially where one or both outputs used has its harmonic structure and phase controlled by selective filtering before summation occurs, however inclusion of these useful combinations would make this description of the preferred embodiment inordinately long, so in interest of brevity, they are considered as a different form of the illustrative embodiment while adhering to the principals of the invention.

The organ tone waves, shaped and controlled by waveshape controlling circuit 3 and amplified by organ preamplifier 4 and organ pulse preamplifier 5 are supplied to organ filters and tab control 10 for finishing of the organ sounds and controlled, at the option of the performer by use of the tabs as to passage of these organ tone waves through vibrato circuit 14 where they have vibrato added to the sound if desired, and through amplifier system and expression control 16 where their strength is increased and controlled, to loudspeaker 17 which converts the electrical signals into audible sound.

The percussion tone waves, shaped and controlled be waveshape controlling circuit 3 and amplified by percussion preamplifier 6 are supplied to percussion filters and tab control 11 for finishing into percussion voices such as piano and harpsichord and controlled, at the option of the performer by use of the tabs as to passage of the percussion tone waves directly into amplifier system and expression control 16 where their strength is increased, to loudspeaker 17 which converts the electrical signals into audible sound.

In like manner, the anti-percussion tone waves, shaped and controlled by waveshape controlling circuit 3, are amplified by anti-percussion preamplifier 7, are supplied to anti-percussion filters and tab control 12 for finishing into an anti-percussion voices such as accordian and controlled, at the option of the performer by use of the tabs as to passage of these tones directly into amplifier system and expression control 16 where their strength is increased and controlled, to loudspeaker 17 which converts the electrical signals into audible sound.

The output of summation preamplifier A 8 and the output of summation preamplifier B 9 are directed to summation filters and tab control 13 where each is individually finished and separately controlled, at the option of the performer by use of the tabs as to passage of these tones through vibrato circuit 15 where vibrato is added to the sound if desired, and through amplifier system and expression control 16 where their strength is increased and controlled, to loudspeaker 17 which converts the electrical signals into audible sound.

In view of the fact that vibrato may not be desired for percussion and anti-percussion tones, but useful an organ tones and summation tones, this embodiment is illustrated with vibrato on organ tones and summation tones only.

Referring to FIG. 2A, which is an embodiment of waveshape controlling circuit 3 of FIG. 1, keyswitch 21 is in the released (open) position and rectangular wave 22 is applied to the end of resistor 23. Current from decay control bus 24 flows through resistor 25 and diode 26 to ground through resistors 27 and 28 thus keeping the voltage across capacitor 29 at a minimum. The signal at the base of transistor 30 from rectangular wave 22 is divided down by resistors 23, 31 and 32 and capacitor 33 and does not go sufficiently positive to cause the base of transistor 30 to conduct. If the D.C. offset of the rectangular wave 22 is such that the positive portion is at ground potential or slightly above, and conditions of the previous sentence are met, then resistor 34 is not required. If, because of reason of the system, or other reason the D. C. offset of rectangular wave 22 is not optimum to meet the conditions of the circuit, resistor 34 is added with bias applied at its end, either positive or negative, as is required to meet these conditions.

When keyswitch 21 is closed, voltage is applied to the voltage divider consisting of resistors 27 and 28, and diode 26 goes out of conduction. From this junction of resistors 27 and 28, current is supplied to charge capacitor 33 through resistor 35 at a controlled rate. As the voltage across capacitor 33 increases, the D.C. offset of the rectangular wave signal at the base of transistor 30 moves in the positive direction causing transistor 30 to conduct on the positive portions of this wave and eventually to saturate on the positive portions of this wave. Thus the attack of the circuit is controlled. Transistor 30 does not conduct on the negative portions of rectangular wave 23.

When transistor 30 is conducting, current is drawn out of organ tone bus 37 through resistor 38, and also current is drawn out of percussion tone bus 39 through diode 40 and resistor 41 by the collector of transistor 30.

When transistor 30 is not conducting, the voltage at the junction or resistors 41 and 45 and cathode of diode 40 becomes more positive than the voltage on percussion tone bus 39 causing diode 40 to cease conducting.

As soon as diode 26 goes out of conduction, capacitor 29 begins to charge due to current supplied to it from decay control bus 24 through resistor 25. As capacitor 29 changes, the voltage across it increases and this in turn imparts a positive D. C. bias at the junction of resistors 41 and 45 and diode 40 through resistor 45. This increasing D. C. bias causes diode 40 to go out of conduction over a larger portion of the positive going portion of the A. C. signal supplied to this junction through resistor 41 from the collector of transistor 30. When capacitor 29 approaches full charge, the values used in the circuit can be selected so that the junction of resistors 41 and 45 is biased positively enough that the A. C. signal supplied through resistor 41 will not cause this point to go negative with respect to percussion tone bus 39 at all, such that diode 40 will not conduct over any portion of the signal. Decay of the percussion tone has now been completed in a controlled manner.

While capacitor 42 is non-essential to the functioning of the circuit, it may be added for the purpose of modifying the waveshape at the collector of transistor 30. When transistor 30 saturates, this capacitor 42 is discharged rapidly into organ pulse tone bus 43. When transistor 30 cuts off, capacitor 42 is charged more slowly through resistor 38 from the voltage on bus 37. In this manner, the waveshape of the current drawn from bus 37 is modified, and a separate current waveshape is inserted into bus 43.

While capacitor 44 is non-essential to the functioning of the circuit, it may be added for the purpose of modifying the waveshape of the current drawn from percussion tone bus 39. It functions to integrate the alternating current supplied to the junction of resistors 41 and 45 through resistor 41 by action of the collector of transistor 30 alternately drawing current, and not drawing current. When the voltage at the cathode of diode 40 goes positive with respect to bus 39, diode 40 stops conducting, and only a portion of this integrated wave is passed on to bus 39. Since diode 40 passes a smaller and smaller portion of this integrated wave on to bus 39 as capacitor 29 charges, this signal has a changing harmonic structure due to this decreasing dwell. Capacitor 44 may therefore be used to effect a change in the harmonic structure of the percussion tone as it dies away.

When tone having an accordian like attack is required from the preferred embodiment of the invention, this is accomplished by the addition of diode 46 connected to anti-percussion tone bus 47. The voltage on bus 47 is set such that at the moment when keyswitch 21 is closed, and capacitor 29 has not begun to charge, it is more positive than the positive peak of the combined A. C. and D. C. voltages at the junction of resistors 41 and 45. Therefore, diode 46 does not conduct, and will not conduct until capacitor 29 has charged to the point where it imparts enough positive D. C. bias at the junction of resistors 41 and 45 through resistor 45 that the positive portion of the A. C. signal appearing at this junction is more positive than bus 47. When this occurs, diode 46 conducts current into accordian tone bus 47. The amount of delay from the closure of keyswitch 21 to the conduction of signal current into bus 47 is controlled by the amount of voltage that bus 47 is above the positive peak of the combined A. C. and D. C. voltages at the junction of resistors 41 and 45 and the charging rate of capacitor 29.

As capacitor 29 charges, causing the D. C. bias at the junction of resistors 41 and 45 to become more positive, the amount of signal current transmitted into bus 47 by diode 46 increases until capacitor 29 reaches full charge. Thus accordian like attack characteristics have been achieved.

When keyswitch 21 is opened, voltage is no longer applied to maintain a charge on capacitor 33, and it discharges through resistor 32. As capacitor 33 discharges, the D. C. offset of the rectangular wave signal at the base of transistor 30 moves in the negative direction until it has returned to the condition where the positive portion of the rectangular wave 22 will not cause transistor 30 to conduct, and this return is controlled by the discharge of capacitor 33. At the same time voltage is no longer applied to hold diode 26 out of conduction so capacitor 29 discharges through the series combination of resistors 27 and 28, thus re-setting the circuit so that it will produce the percussion tone as well as the organ tone and the anti-percussion tone the next time the keyswitch 21 is closed. The circuit values are chosen so that capacitor 33 discharges more rapidly than capacitor 29 to avoid a momentary increase of signal on percussion tone bus 39 when keyswitch 21 is opened.

FIG. 2B is a variation on the circuit of FIG. 2A wherein diode 40 of FIG. 2A has been replaced by resistor 51 of FIG. 2B and resistor 45 of FIG. 2A has been replaced by diode 52 of FIG. 2B. Capacitors 42 and 44 and bus 43 of FIG. 2A have been removed for the sake of simplicity, but may be used if desired. Diode 46 and bus 47 of FIG. 2A have been removed. This variation operates exactly the same as FIG. 2A which has been already described with the exception of the action of resistor 51 and diode 52.

When transistor 30 is keyed into operation, its collector draws current from bus 37 through resistor 38 and also from percussion tone bus 53 through the series combination of resistors 41 and 51. This current is alternating since transistor 30 conducts alternatively as has been previously described. The voltage at the junction of resistors 41 and 51 is therefore alternating, and its negative going peak is still positive with respect to ground because it can be no lower than the voltage division of resistors 41 and 51 from the voltage of percussion tone bus 52, and the voltage across capacitor 29 is initially lower than this negative going peak. Therefore, diode 52 does not initially conduct.

As the keyswitch is held closed, capacitor 29 charges due to current supplied to it from bus 24 through resistor 25 in accordance with the previous description, and the voltage across it rises so that diode 52 conducts when the negative going voltage at the junction of resistors 41 and 51 equals the voltage across capacitor 29. The current drawn by the collector of transistor 30 through resistor 41 is now supplied by capacitor 29 through diode 52 instead of from bus 53 through resistor 51. The current variation from bus 53 has therefore been diminished thus diminishing the signal strength.

As capacitor 29 continues to charge, it supplies more average current to the collector of transistor 30 through resistor 41 and diode 52 on the negative going portions of the cycle, and bus 53 supplies less average current over the positive going portions of the cycle, thus the signal strength at percussion tone bus 53 is further diminished. When the voltage across capacitor 29 equals the voltage at the junction of resistors 41 and 51 when transistor 30 is in the non-conducting portion of its cycle, then no current is supplied by bus 53 since all the current is now supplied by capacitor 29, and the decay of the signal at percussion tone bus 53 has been completed in a controlled manner.

FIG. 2B has been shown and described to illustrate one of many variations on the basic invention and to illustrate that the invention in its broader aspects is not limited to the specific details shown and described herein, and to illustrate that variations may be made in the circuit without departing from the principals of the present invention.

Since the waveshape controlling circuit 3 of FIG. 1 is used in an instrument of polyphonic capability, one such circuit being used for each key, organ tone bus 37 of FIG. 2A collects the tone from a multiplicity of circuits. In like manner percussion tone bus 39, organ pulse tone bus 43 and anti-percussion tone bus 47 of FIG. 2A collects their respective tone from a multiplicity of circuits. Also in like manner, organ tone bus 37 of FIG. 2B and percussion tone bus 53 collects their respective tone from a multiplicity of circuits.

Each of these busses is connected individually to the input of an individual preamplifier which in FIG. 1 is represented as organ preamplifier 4 (bus 37), organ pulse preamplifier 5 (bus 43), percussion preamplifier 6 (bus 39), and anti-percussion preamplifier 7 (bus 47).

It is preferable that this preamplifier be of the low input impedance type, an example of which is given in FIG. 3 and consists of resistors 61 and 62 and transistor 63. This is because the use of this type of preamplifier results in good isolation between the like outputs of individual waveshape controlling circuits, and since two or more circuits may be rendered operative during a given time, the desirable result of minimum of intermodulation distortion is achieved. Since busses 37, 39, 47 and also 53 require a positive potential for proper operation of the waveshape controlling circuit, this may be accomplished by direct connecting these busses to the emitter of their respective low input impedance preamplifier an example of which is illustrated in FIG. 3, and the voltage supplied to the bus is controlled by the voltage amount of + bias supplied to the base of transistor 63 of FIG. 3.

Referring to FIG. 4, which is an embodiment of organ preamplifier 4 plus anti-percussion preamplifier 6 plus summation of preamplifier B 8 all of FIG. 1, organ tone, several notes of which are gathered together at bus 37 is amplified by a low input impedance preamplifier consisting of resistors 71 and 72 and transistor 73, and amplified organ tone is supplied to succeeding circuitry from the collector of this transistor.

In like manner, anti-percussion tone, several notes of which are gathered together at bus 47 is amplified by a low input impedance preamplifier consisting of resistors 74 and 75 and transistor 76 and also resistors 77 and 78 which supply a somewhat lower bias to the base of transistor 76 than that supplied to the base of transistor 73. Amplified anti-percussion tone is supplied to succeeding circuitry from the collector of transistor 76.

Some organ tone is supplied to the emitter of transistor 80 through resistor 81, and some anti-percussion tone is supplied to the base of transistor 80 through resistor 82 while resistor 83 helps control the bias and signal strength at this base. The summation preamplifier is completed by emitter resistor 84 and collector resistor 85, and summation tone is supplied to succeeding circuitry from the collector of transistor 80.

This summation tone is characterized by a change in harmonic structure as the key is held, and since each key has its own waveshape controlling circuit, this being a polyphonic instrument, each note changes harmonic structure relative to the actuation of its own keyswitch, and independent from the actuation of any other keyswitch on the keyboard. When the key is first actuated, the tone, in this example, will have a strong fundamental and weaker harmonics, and as the key is held, the harmonics become more prominent while the fundamental diminishes. Depending on the circuit values chosen for summation, the fundamental can then be made to become stronger, but in the opposite phase as the holding of the key is continued.

When bus 39 is substituted for bus 47 in FIG. 4, this figure becomes an embodiment of organ preamplifier 4, plus percussion preamplifier 5, plus summation preamplifier A 7 all of FIG. 1. Transistor 73 now supplies percussion tone to succeeding circuitry from its collector, and percussion tone is supplied to the base of transistor 80 through resistor 82. The summation of organ tone and percussion tone is accomplished in the summation preamplifier of which transistor 80 is a part and summation tone is supplied to succeeding circuitry from the collector of transistor 80.

This summation tone is characterized by a change in harmonic structure as the key is held, and since each key has its own wavesahpe controlling circuit, as has been previously described, each note changes harmonic structure relative to the action of its own keyswitch and independent from the action of other keyswitches. When the key is first actuated, the tone in this examplw will be rich in harmonics, but have a weak fundamental, and as the key is held, the fundamental becomes stronger and the harmonics become less prominent.

It may be seen by one skilled in the art that many and various summation tones or waveshapes having useful and desirable characteristics are readily available from this invention and it should be understood that this description of the preferred embodiment does not and is not intended to limit the invention to the summation tones or waveshapes illustrated.

FIG. 5 illustrates one set of waveshapes and their envelopes of attack and release that may be obtained from the preferred embodiment. A frequency divider of a type often used in electronic organs may be used to produce rectangular wave 22 of FIG. 2A which is shown as FIG. 5A. The waveshape of the current drawn from organ tone bus 37 by the circuit, when keyed into operation, is shown as FIG. 5B with modification caused by the action of capacitor 42. Its attack upon closure of keyswitch 21, and its release upon opening of keyswitch 21 is shown. The waveshape of the current appearing on organ pulse tone bus 43 (if used), when keyed into operation, is shown as FIG. 5C. Its attack and release is similar to that of the waveshape of FIG. 5B.

The waveshape of the current drawn from percussion tone bus 39, when keyed into operation is shown as FIG. 5D with modifications caused by capacitors 42 and 44 and by action of diode 40. Its attack, upon closure of keyswitch 21 is similar to that of the waveshape of FIG. 5B. Its release, however, is controlled by the charging of capacitor 29 and the action of diode 40 so if keyswitch 21 is held closed long enough, the waveshape appearing on bus 39 can decay completely before the key is released.

The waveshape of the current put into anti-percussion tone bus 47 of FIG. 2A when keyed into operation is shown as FIG. 5E, with modifications caused by capacitors 42 and 44 and by action of diode 46. Its attack, upon closure of keyswitch 21 is delayed, and builds up slowly, controlled by the charging of capacitor 29 and the action of diode 47 so if keyswitch 21 is held closed long enough, this waveshape will stabilize at its maximum amplitude. When keyswitch 21 is opened, its release is similar to that of the waveshape of FIG. 5B.

A waveshape appearing at the collector of transistor 80 of FIG. 4 when bus 37 and bus 47 of FIG. 2A are connected to the emitters of transistors 73 and 76 respectively is shown as FIG. 5F.

A waveshape appearing at the collector of transistor 80 of FIG. 4 when bus 37 and bus 39 of FIG. 2A are connected to the emitters of transistors 73 and 76 respectively is shown as FIG. 5G.

While one embodiment of the invention is shown and described herein, the invention is susceptible of embodiment in many different forms and it should be understood that the present disclosure is to be considered as an exemplification of the principals of the invention and is not intended to limit the invention to the embodiment illustrated.

What is claimed is:

1. An electronic musical instrument for obtaining certain musical effects comprising in combination:

a plurality of frequency sources supplying rectangular waves continuously at a given rate, each of which corresponds to a semitone of the musical scale;

a plurality of key switching means;

a plurality of waveshape controlling means, each of which is connected to a corresponding one of said frequency sources, and each of which has a minimum of two outputs;

a first of said outputs producing a waveshape having a plurality of selected harmonics and rendered operative by one of said plurality of key switching means and;

a second of said outputs producing a waveshape having a plurality of selected harmonics and rendered operative by the same said one of said keyswitches but the amplitude of said waveshape being controlled by said waveshape controlling means while said keyswitch is rendering it operative for the purpose of obtaining certain musical effects;

filter means responsive to each output for adjusting the amplitudes of said harmonics to conform to the desired timber of said organ tone, and also of said musical effects and;

signal translating means responsive to the output of each filter means to produce audible musical tones.

2. An electronic musical instrument as defined in claim 1 wherein:

said second of said outputs having circuit means for producing a waveshape having initially a large amplitude when rendered operative by said key switching means; and said amplitude decreases to an amplitude level smaller than the initial amplitude as said key switching means continues to render said circuit operative in a manner similar to the percussion effect of the piano tone.

3. An electronic musical instrument as defined in claim 1 wherein:

said second of said outputs having circuit means for producing a waveshape when rendered operative by said key switching means, and said amplitude gradually increasing as said key switching means continues to render said circuit operative in a manner similar to the anti-percussion effect of the accordian tone.

4. An electronic musical instrument as defined in claim 1 including:

selective means coupled to said waveshape controlling means including a resistor and diode network for selecting a predetermined one or combination of ones of said outputs for producing waveshapes when rendered operative by said key switching means whereby the amplitude of said waveshapes are altered by said network as said key switching means continues to render said circuit operative in a manner similar to anti-percussion and percussion effects of piano and accordian tones.

5. The electronic musical instrument as defined in claim 1 wherein:

said instrument is a polyphonic musical instrument simulator including a plurality of preamplifiers coupled to said first and second outputs that produces organ, organ pulse, percussion and anti-percussion effects;

summation preamplifiers connected to said plurality of preamplifiers for receiving the produced effects thereof;

a filter network connected to the output of said summation amplifiers including tab control for selective combination of filtered effects from said summation preamplifiers; and vibrato and expression circuits interconnecting said filter network to a loudspeaker system.

6. An electronic musical instrument as defined in claim 1 wherein:

said second of said outputs is a duality;

the first of which produces a waveshape initially a large amplitude when rendered operative by said key switching means, and said amplitude decreases to an amplitude level smaller than the initial amplitude in a manner similar to the percussion effect of the piano tone; and the second of which independently produces a waveshape initially small when rendered operative by said key switching means, and said amplitude increases in a manner similar to the anti-percussion effect of the accordian tone;

both being produced as said key switching means continues to render said circuit operative.

7. An electronic musical instrument as defined in claim 1 wherein:

said second output is changed to one producing a waveshape having a plurality of selected harmonics and rendered operative by the same one of said keyswitches but the relative strength of said selected harmonics of said waveshape being controlled as a function of time by said waveshape controlling means while said key switching means continues to render said circuit operative for the purpose of achieving certain musical effects.

8. An electronic musical instrument as defined in claim 7 including:

said instrument being polyphonic and includes a plurality of preamplifiers coupled to said first and second outputs for producing organ tone and said above mentioned waveshape;

summation preamplifier connected to said plurality of said preamplifiers for receiving the produced waveshapes thereof.

9. An electronic musical instrument as defined in claim 2 including:

means for the summation of organ tone waveshape with a percussion effect waveshape for the purpose of strengthening and weakening certain harmonics of the resulting tone signals as a function of time as the keyswitch is held closed to provide further enhancement of the tonal resources of the instrument.

10. An electronic musical instrument as defined in claim 2 including:

means for controlling the relative strength of said selected harmonics of said waveshape of said second of said outputs as a function of time as said key switching means continues to render said circuit operative.

11. An electronic musical instrument as defined in claim 3 including:

means for controlling the relative strength of said selected harmonics of said waveshape of said second of said outputs as a function of time as said key switching means continues to render said circuit operative.

12. An electronic musical instrument as defined in claim 3 including:

means for the summation of organ tone waveshape with an anti-percussion effect waveshape for the purpose of strengthening and weakening certain harmonics of the resulting tone signals as a function of time as the keyswitch is held closed to provide further enhancement of the tonal resources of the instrument.

13. An electronic musical instrument as defined in claim 4 including:

means for the summation of organ tone waveshape with percussion and anti-percussion effect waveshape for the purpose of strengthening and weakening certain harmonics of the resulting tone signals as a function of time as the keyswitch is held closed to provide further enhancement of the tonal resources of the instrument.

* * * * *